US012722849B2

(12) United States Patent
Funaki et al.

(10) Patent No.: US 12,722,849 B2
(45) Date of Patent: Sep. 1, 2026

(54) TRAY-EQUIPPED PALLET AND PACKAGING MEMBER INCLUDING SAME

(71) Applicant: KYOCERA Document Solutions Inc., Osaka (JP)

(72) Inventors: Keiichi Funaki, Osaka (JP); Atsushi Itano, Osaka (JP); Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/169,717

(22) Filed: Apr. 3, 2025

(65) Prior Publication Data

US 2025/0320028 A1 Oct. 16, 2025

(30) Foreign Application Priority Data

Apr. 10, 2024 (JP) ..... 2024-063176
Jun. 7, 2024 (JP) ..... 2024-092901

(51) Int. Cl.
*B65D 19/06* (2006.01)
*B65D 19/44* (2006.01)

(52) U.S. Cl.
CPC ..... *B65D 19/06* (2013.01); *B65D 19/44* (2013.01); *B65D 2519/00492* (2013.01); *B65D 2519/009* (2013.01); *B65D 2519/0099* (2013.01)

(58) Field of Classification Search
CPC ..... B65D 19/06; B65D 19/10; B65D 19/20; B65D 19/44; B65D 2519/00024; B65D 2519/00029; B65D 2519/00034; B65D 2519/00273; B65D 2519/00288; B65D 2519/00293; B65D 2519/00298; B65D 2519/00323; B65D 2519/00333; B65D 2519/00492; B65D 2519/00502; B65D 2519/00512; B65D 2519/00611; B65D 2519/00656; B65D 2519/00661; B65D 2519/009; B65D 2519/0096; B65D 2519/00975; B65D 2519/0099
(Continued)

(56) References Cited

U.S. PATENT DOCUMENTS 7,426,890 B2 * 9/2008 Olvey ..... B65D 19/0036 108/56.1
7,896,159 B2 * 3/2011 Goda ..... B65D 19/20 206/386
8,256,615 B2 * 9/2012 Goda ..... B65D 19/06 206/386

FOREIGN PATENT DOCUMENTS

EP 2065311 A1 * 6/2009 ..... B65D 19/0026
JP 05193644 A * 8/1993 ..... B65D 5/44
(Continued)

*Primary Examiner* — Bryon P Gehman
(74) *Attorney, Agent, or Firm* — Stein IP, LLC

(57) ABSTRACT

A tray-equipped pallet includes a pallet, a tray, and a support plate. The tray is made of a sheet and includes a rectangular bottom surface secured to a top plate of the pallet. The support plate is secured to overlie the bottom surface of the tray. The pallet includes a connection portion that protrudes from an upper surface of the top plate and to which the support plate is secured. The tray includes an engagement hole that is formed in the bottom surface and with which the connection portion engages, a first zipper portion that enables separation of the bottom surface into first and second bottom surface portions, and a second zipper portion that enables breakage of a part of the engagement hole on an opposite side to the first zipper portion.

10 Claims, 6 Drawing Sheets

(58) Field of Classification Search
USPC ..... 206/386, 600
See application file for complete search history.

(56) References Cited

FOREIGN PATENT DOCUMENTS

| | | | | | |
|---|---|---|---|---|---|
| JP | H11334718 | A | * | 12/1999 | ..... B65D 19/20 |
| JP | H11334736 | A | * | 12/1999 | ..... B65D 19/20 |
| JP | 2002-205738 | A | | 7/2002 | |
| WO | WO-9900310 | A1 | * | 1/1999 | ..... B65D 19/20 |

* cited by examiner

TRAY-EQUIPPED PALLET AND PACKAGING MEMBER INCLUDING SAME

INCORPORATION BY REFERENCE

This application is based upon and claims the benefit of priority from the corresponding Japanese Patent Application Nos. 2024-063176 and 2024-092901 filed on Apr. 10, 2024 and Jun. 7, 2024, respectively, the entire contents of which are hereby incorporated by reference.

BACKGROUND

The present disclosure relates to a tray-equipped pallet including a pallet and a tray that are made of different materials and are secured together and to a packaging member including the tray-equipped pallet.

Conventionally, there has been widely used a method for packing a product by placing the product on a tray-equipped pallet and then covering the product with a cylindrical upper case. In this method, the pallet is servable also as a bottom surface of a packaging case, and thus there is no need for the packaging case in which the product has been packed to be further placed on another pallet. This facilitates packing and transport, particularly of a heavyweight product such as an electronic device.

Here, a pallet portion of the tray-equipped pallet is required to support a heavyweight product and thus is often made of a high-strength material such as metal or wood. A tray portion of the tray-equipped pallet, on the other hand, is not required to have strength and thus is often made of a corrugated cardboard sheet. Because of this, disposal of the tray-equipped pallet requires, for enhanced recyclability, that the tray-equipped pallet be separated into a tray and a pallet that are made of different materials.

SUMMARY

A tray-equipped pallet according to one aspect of the present disclosure includes a pallet, a tray, and a support plate. The pallet includes a plurality of columns and top and bottom plates secured respectively to upper and lower surfaces of the columns. The tray is made of a sheet and includes a rectangular bottom surface secured to the top plate of the pallet. The support plate is secured to overlie the bottom surface of the tray. The pallet includes a connection portion that protrudes from an upper surface of the top plate and to which the support plate is secured. The tray includes an engagement hole that is formed in the bottom surface and with which the connection portion engages, a first zipper portion that enables separation of the bottom surface into a first bottom surface portion on one side and a second bottom surface portion on the other side, and a second zipper portion that is formed to adjoin the engagement hole and enables breakage of a part of the engagement hole on an opposite side to the first zipper portion. After the first and second zipper portions have been torn off, each of the first and second bottom surface portions is pulled out in an opposite direction to the broken part of the engagement hole, and thus separation of the tray from the pallet and the support plate is enabled.

DETAILED DESCRIPTION

Figure 1:
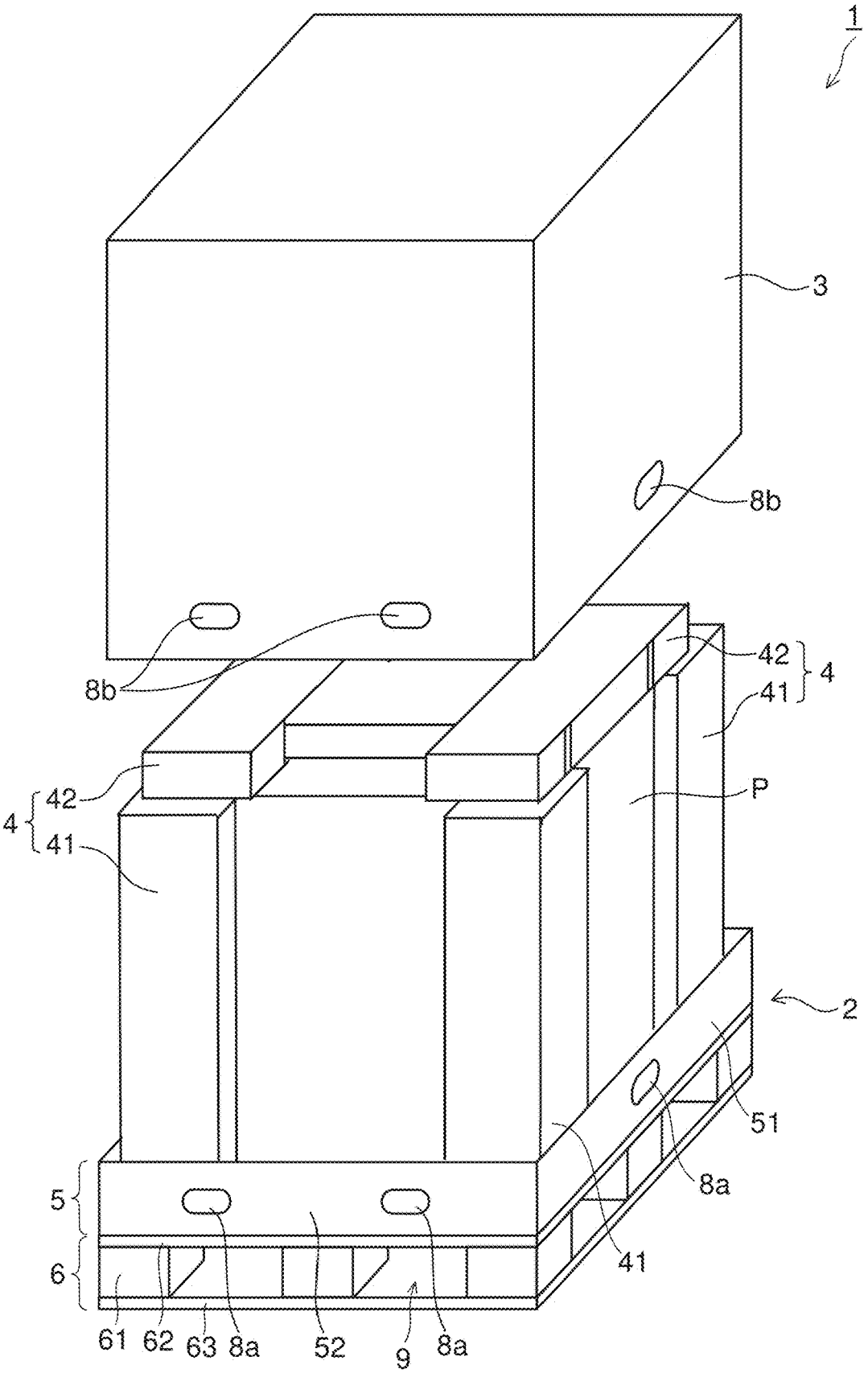
FIG. 1 is a perspective view showing a state where a product is arranged in a packaging member including a tray-equipped pallet according to the present disclosure.

With reference to the appended drawings, the following describes embodiments of the present disclosure. FIG. 1 is a perspective view showing a state where a product P is arranged in a packaging member 1 including a tray-equipped pallet 2 according to the present disclosure. As shown in FIG. 1, the packaging member 1 is composed of the tray-equipped pallet 2, an upper case 3, and a buffer member 4.

The tray-equipped pallet 2 is composed of a tray 5 and a pallet 6 secured to a lower surface of the tray 5. The tray 5 is made of a corrugated cardboard sheet and includes a rectangular bottom surface 50 (see FIG. 2) on which the product P is placed and a pair of first flaps 51 and a pair of second flaps 52 that are connected to four sides of the bottom surface 50. The first and second flaps 51 and 52 have through holes 8*a* formed at prescribed locations thereon.

The pallet 6 is made of wood and is composed of a plurality of columns 61 and a top plate 62 and a bottom plate 63 that are secured respectively to upper and lower surfaces of the columns 61. Between each pair of adjoining ones of the columns 61, there is formed an arm insertion hole 9 for receiving an arm of a forklift truck or a hand pallet truck (a pallet transport cart) inserted thereinto.

The tray-equipped pallet 2 serves also as a bottom surface of the packaging member 1, and thus there is no need for the packaging member 1 in which the product P has been packed to be further placed on another pallet. This facilitates packing and transport, particularly of a large-sized product or the like. A detailed configuration of the tray-equipped pallet 2 will be described later.

The upper case 3 is made of a corrugated cardboard sheet and has a rectangular parallelepiped shape with an open bottom surface, thus covering side and upper surfaces of the product (an article to be packed) P. The upper case 3 has, at lower ends thereof, through holes 8*b* formed at such positions as to overlap the through holes 8*a* in the first and second flaps 51 and 52. A fastener (not shown) is inserted into each of the through holes 8*a* and a corresponding one of the through holes 8*b* in a state of overlapping each other so that the tray-equipped pallet 2 and the upper case 3 are integrally connected together. While this embodiment uses the upper case 3 whose cylindrical side surface portions and top surface portion are integrally formed, an upper case separable into side surface portions and a box-shaped top surface portion may also be used as the upper case 3.

The buffer member 4 is arranged in a gap between the product P and the upper case 3 so as to protect the product P from any external impact. The buffer member 4 is formed by bending a corrugated cardboard sheet into a prescribed shape. As the buffer member 4, there are provided side surface buffer members 41 arranged on side surfaces of the product P and upper surface buffer members 42 arranged on an upper surface of the product P.

The side surface buffer members 41 are arranged along an up-down direction so as to cover four corners of the product P between the side surfaces thereof. Prescribed gaps are formed between the side surface buffer members 41 and the first and second flaps 51 and 52, and the lower ends of the upper case 3 are inserted into these gaps. Two upper surface buffer members 42 are arranged side by side on the upper surface of the product P.

Figure 2:
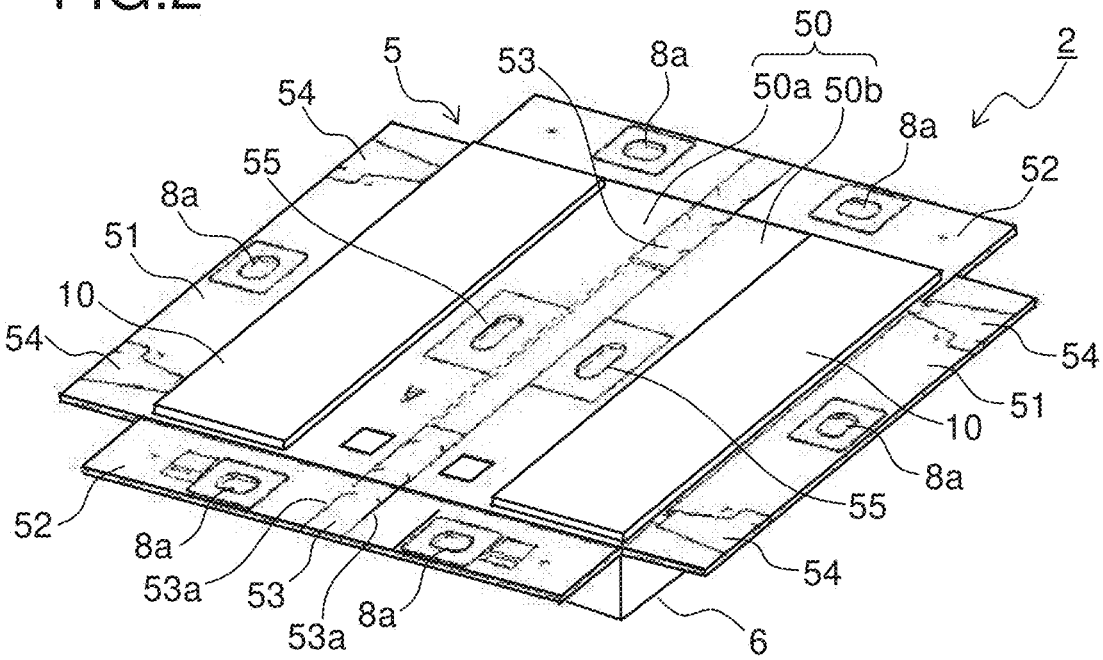
FIG. 2 is a perspective view of a tray-equipped pallet according to a first embodiment of the present disclosure as a component of the packaging member.
Figure 3:
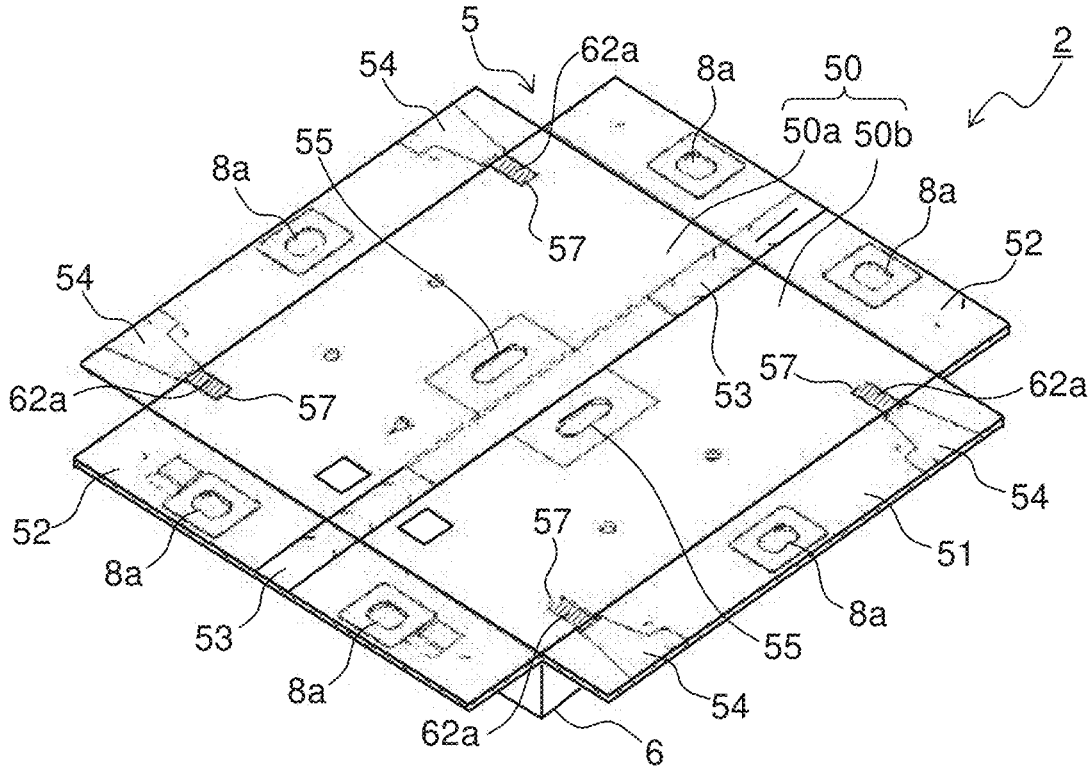
FIG. 3 is a perspective view showing a state where support plates have been removed from the tray-equipped pallet according to the first embodiment.

FIG. 2 is a perspective view of a tray-equipped pallet 2 according to a first embodiment of the present disclosure as a component of the packaging member 1. FIG. 3 is a perspective view showing a state where support plates 10 have been removed from the tray-equipped pallet 2 according to the first embodiment. As shown in FIG. 2 and FIG. 3, a tray 5 is formed by punching a single corrugated cardboard sheet into a prescribed shape and includes a rectangular bottom surface 50, a pair of first flaps 51 provided at opposed two sides of the bottom surface 50 so as to be continuous with the bottom surface 50 via a crease line, a pair of second flaps 52 provided at the other two sides of the bottom surface 50 so as to be continuous with the bottom surface 50 via a crease line, a first zipper portion 53, a second zipper portion 54, a grasping portion 55, and an engagement hole 57.

The first zipper portion 53 is a region interposed between two first breaking lines (perforations) 53*a* extending from each of the pair of second flaps 52 to the bottom surface 50 across a crease line. A gap is formed between the first zipper portions 53. The bottom surface 50 is partitioned into a first bottom surface portion 50*a* on one side (an upper left side in FIG. 2) with respect to the first breaking lines 53*a* of the first zipper portions 53 and a second bottom surface portion 50*b* on the other side (a lower right side in FIG. 2) with respect thereto.

The second zipper portion 54 is a region enclosed with two second breaking lines (perforations) 54*a* extending from a distal end of each of the pair of first flaps 51 toward a neighboring one of the first and second bottom surface portions 50*a* and 50*b*. The second zipper portion 54 is formed at each of two locations on each of the pair of first flaps 51, i.e., there are formed four second zipper portions 54 in total.

The grasping portion 55 is formed at substantially a middle of each of respective sides of the first and second bottom surface portions 50*a* and 50*b* opposed to each other via the first zipper portions 53.

On the first and second bottom surface portions 50*a* and 50*b*, the engagement hole 57 is formed at each of four locations adjoining the second zipper portions 54 via the crease line. A wooden connection portion 62*a* protruding from an upper surface of a top plate 62 of a pallet 6 engages with the engagement hole 57. The connection portion 62*a* has a thickness (a protruding amount from the top plate 62) substantially equal to a thickness of the bottom surface 50.

A pair of support plates 10 is overlaid on the bottom surface 50. The support plates 10 are made of wood and are secured along two respective sides of the first and second bottom surface portions 50*a* and 50*b* adjoining the first flaps 51. The support plates 10 are opposed to casters (not shown) provided at four corners of the product P.

In assembling the tray-equipped pallet 2, the tray 5 is overlaid on the top plate 62 of the pallet 6. At this time, as shown in FIG. 3, the connection portion 62*a* formed at each of four locations on the top plate 62 is caused to engage with the engagement hole 57 in the tray 5. This achieves positioning of the tray 5 with respect to the pallet 6. Further, the support plates 10 are secured on top of the tray 5.

Figure 4:
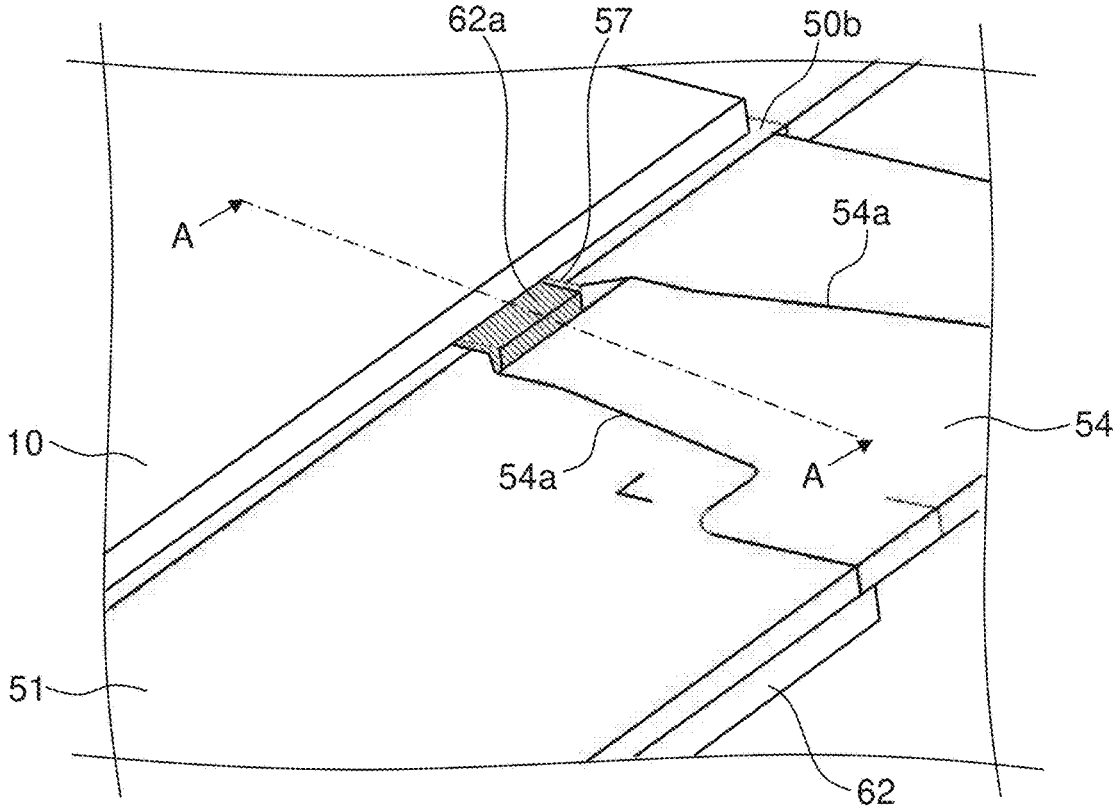
FIG. 4 is an enlarged perspective view of and around a second zipper portion of the tray-equipped pallet according to the first embodiment.
Figure 5:
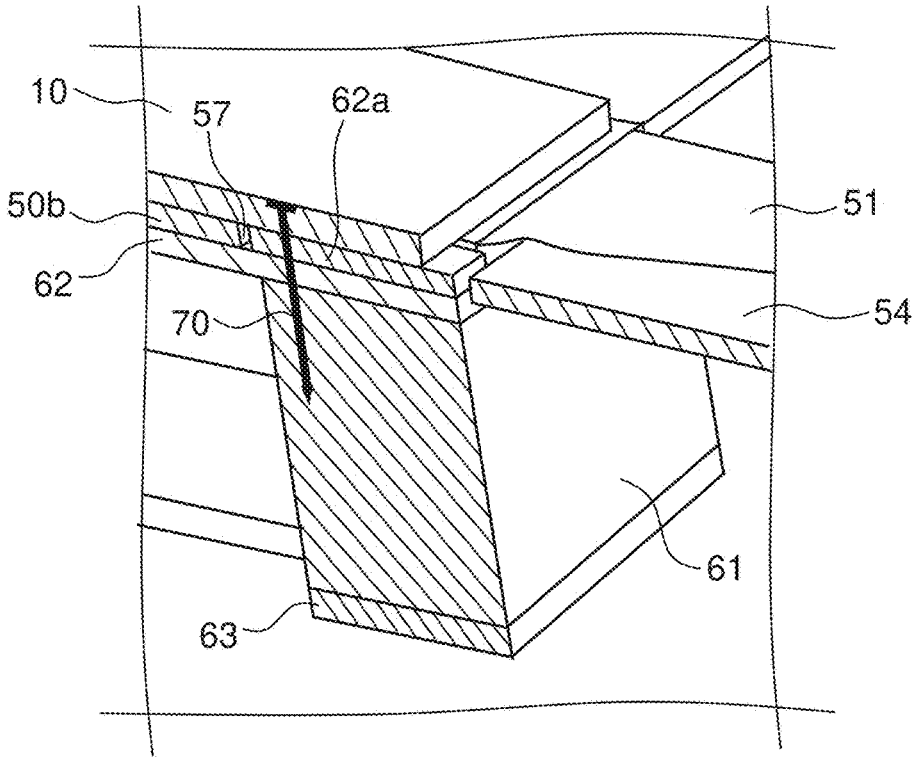
FIG. 5 is a sectional view of and around a connection portion of the tray-equipped pallet according to the first embodiment.

FIG. 4 is an enlarged perspective view of and around the second zipper portion 54 of the tray-equipped pallet 2 according to the first embodiment. FIG. 5 is a sectional view (a sectional view taken in a direction indicated by arrows A-A in FIG. 4) of and around the connection portion 62*a* of the tray-equipped pallet 2 according to the first embodiment. While FIG. 4 and FIG. 5 show a view of and around one of the second zipper portions 54 positioned at a right end in FIG. 2, the other three second zipper portions 54 also have a similar configuration.

As shown in FIG. 4, one of the support plates 10 shown therein is arranged along a boundary portion between the second bottom surface portion 50*b* and a neighboring one of the first flaps 51 and overlies the connection portion 62*a*. In this state, as shown in FIG. 5, from an upper surface of the one of the support plates 10, a nail 70 is driven into the connection portion 62*a* so as to penetrate through the one of the support plates 10, the connection portion 62*a*, and the top plate 62 to reach a corresponding one of columns 61. Thus, the one of the support plates 10, the connection portion 62*a*, and the top plate 62 are secured by use of the nail 70.

While the tray 5 is not secured by use of the nail 70, in a state where the one of the support plates 10 is secured to the connection portion 62*a*, the engagement hole 57 formed in the second bottom surface portion 50*b* engages with the connection portion 62*a*. Consequently, horizontal movement of the bottom surface 50 is restricted through engagement between the engagement hole 57 and the connection portion 62*a*. Furthermore, upward movement of the bottom surface 50 is restricted by the support plates 10. That is, the tray 5 is secured in a state of being held in a gap between the top plate 62 and each of the support plates 10.

Next, a description is given of a procedure for separating, from each other, the tray 5 and the pallet 6 of the tray-equipped pallet 2 according to this embodiment. First, from a state shown in FIG. 2, the two first zipper portions 53 are torn off along the first breaking lines 53*a*. Thus, the tray 5 is severed at a middle of each of the second flaps 52 so as to be divided into an area including the first bottom surface portion 50*a* and an area including the second bottom surface portion 50*b*.

Figure 6:
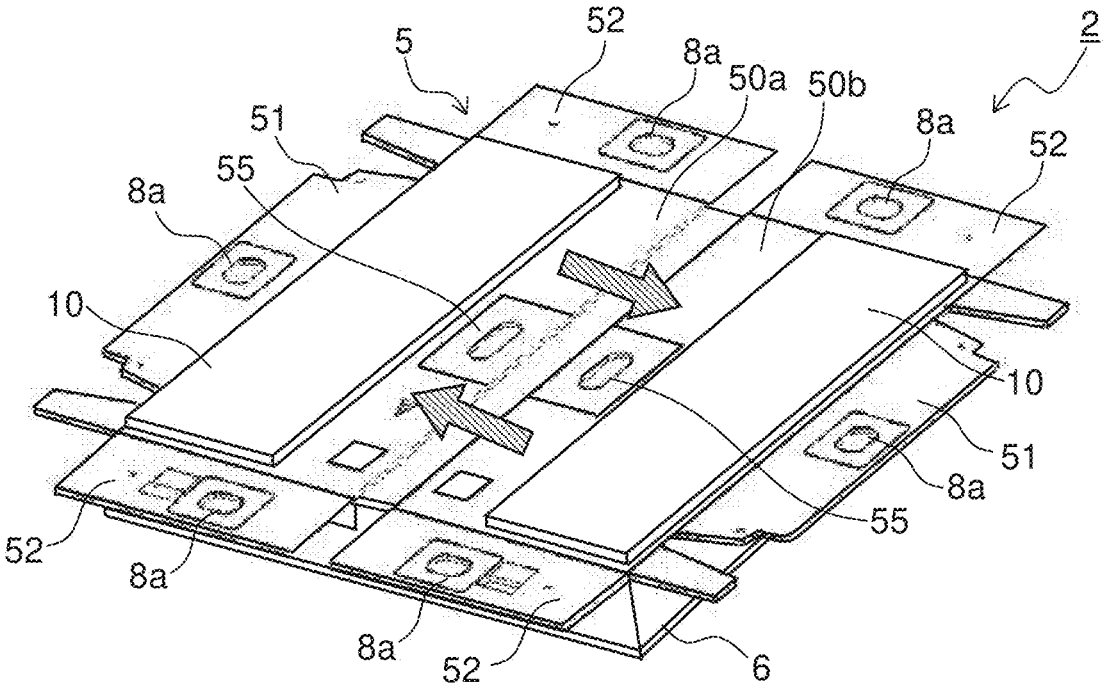
FIG. 6 is a perspective view showing a state where first and second zipper portions have been cut off from the tray-equipped pallet according to the first embodiment.

Next, the four second zipper portions 54 in the first flaps 51 are torn off along the second breaking lines 54*a*. FIG. 6 is a perspective view showing a state where the first and second zipper portions 53 and 54 have been cut off from the tray-equipped pallet 2 according to the first embodiment.

In the state shown in FIG. 6, where the second zipper portions 54 have been cut off, ends of the engagement holes 57 near the first flaps 51, which used to adjoin the second zipper portions 54, are now opened. Consequently, the areas of the tray 5 including the first and second bottom surface portions 50*a* and 50*b*, respectively, become movable to opposite sides to the first flaps 51 (to an inner side of the pallet 6).

Thus, it is possible, by grasping the grasping portion 55 in each of the areas including the first and second bottom surface portions 50*a* and 50*b*, respectively, to pull out these areas in opposite directions to the first flaps 51 (in directions of hatched arrows in FIG. 6).

Figure 7:
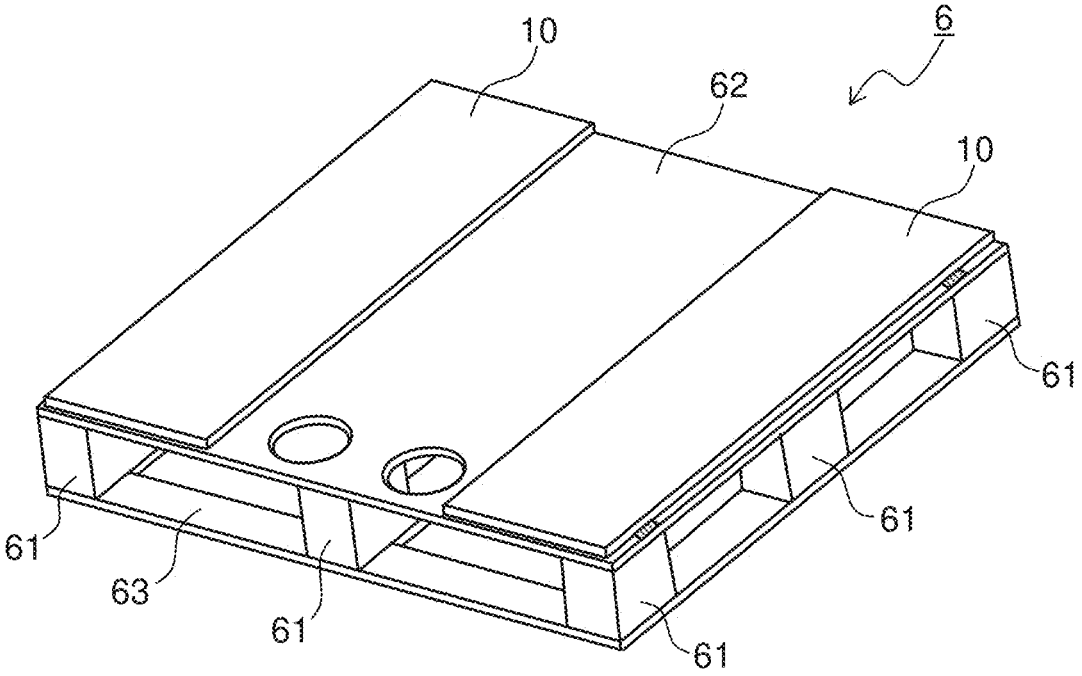
FIG. 7 is a perspective view of a pallet obtained after a tray has been pulled out and separated from the tray-equipped pallet in FIG. 6.

FIG. 7 is a perspective view of the pallet 6 obtained after the tray 5 has been pulled out and separated from the tray-equipped pallet 2 in FIG. 6. In the pallet 6 from which the tray 5 has been pulled out, there only remains the columns 61, the top plate 62, a bottom plate 63, the connection portions 62*a*, and the support plates 10, which are all made of wood.

According to a configuration of this embodiment, when the tray-equipped pallet 2 is disposed of, the first zipper portions 53 and the second zipper portions 54 are torn off so that the tray-equipped pallet 2 can be separated into the tray 5 made of a corrugated cardboard sheet and other wooden parts that are the pallet 6 and the support plates 10. As a result, it is possible to easily separate the tray 5 without using a tool such as a nail puller, a screwdriver, or the like.

Accordingly, when the used tray-equipped pallet 2 is disposed of or recycled, workability in separating/sorting parts thereof is improved, and this renders the packaging member 1 excellent also in terms of environmental friendliness.

Figure 8:
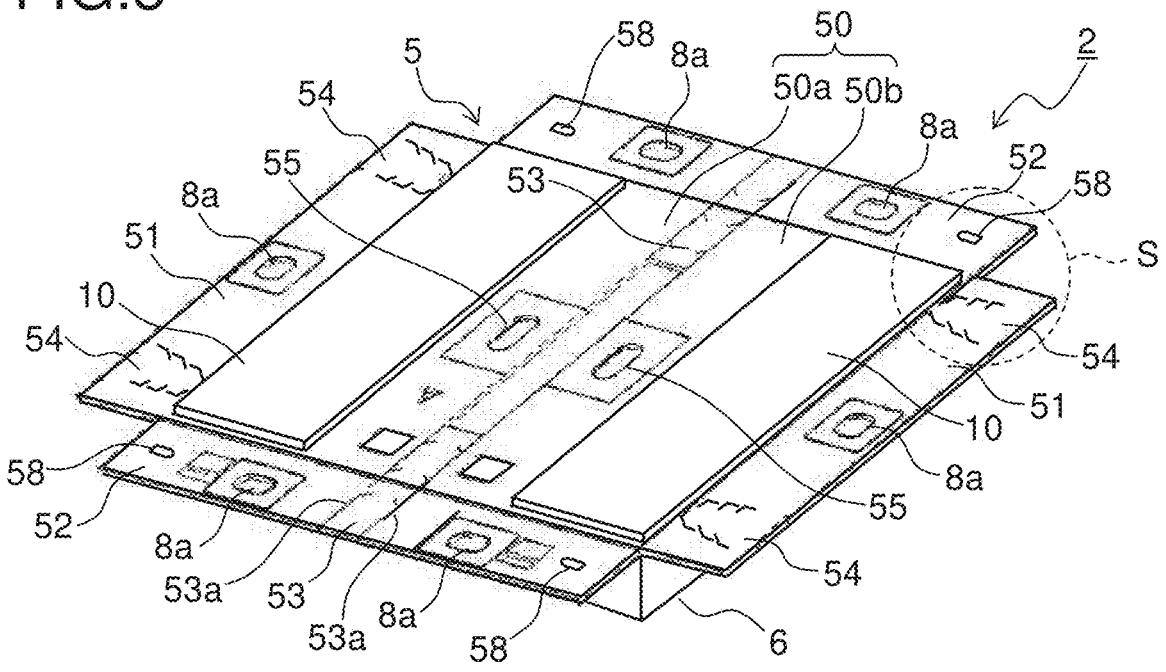
FIG. 8 is a perspective view of a tray-equipped pallet according to a second embodiment of the present disclosure.
Figure 9:
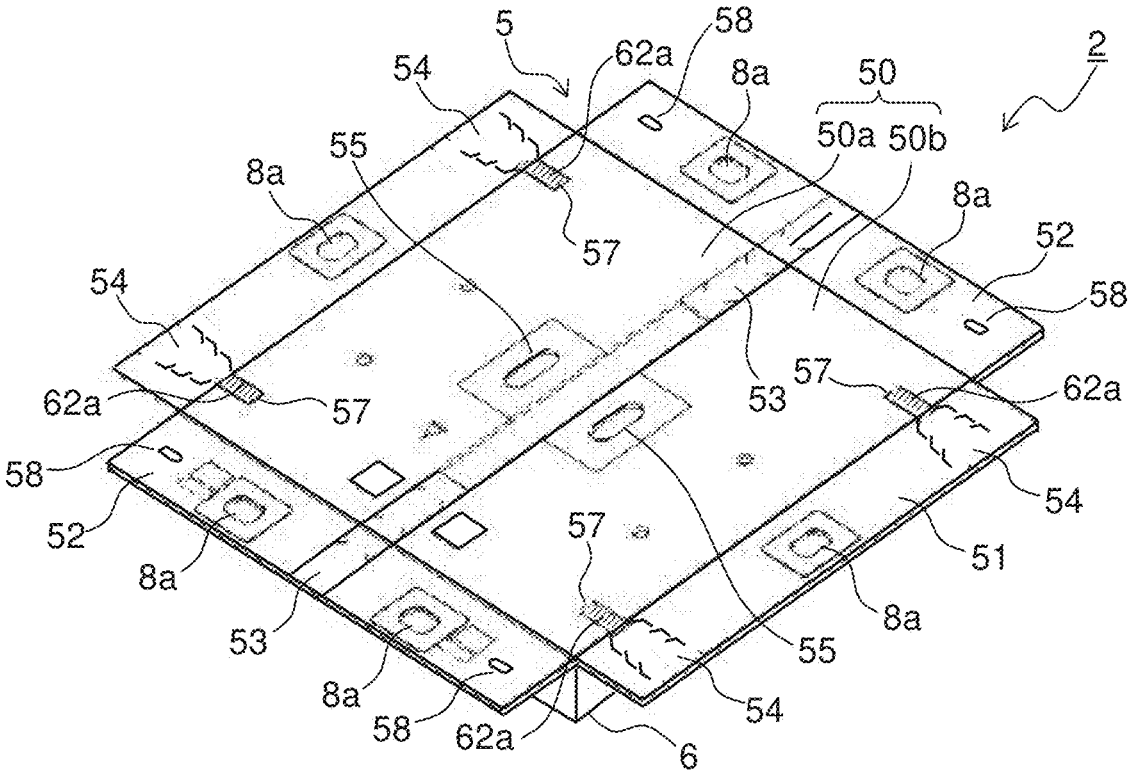
FIG. 9 is a perspective view showing a state where support plates have been removed from the tray-equipped pallet according to the second embodiment.
Figure 10:
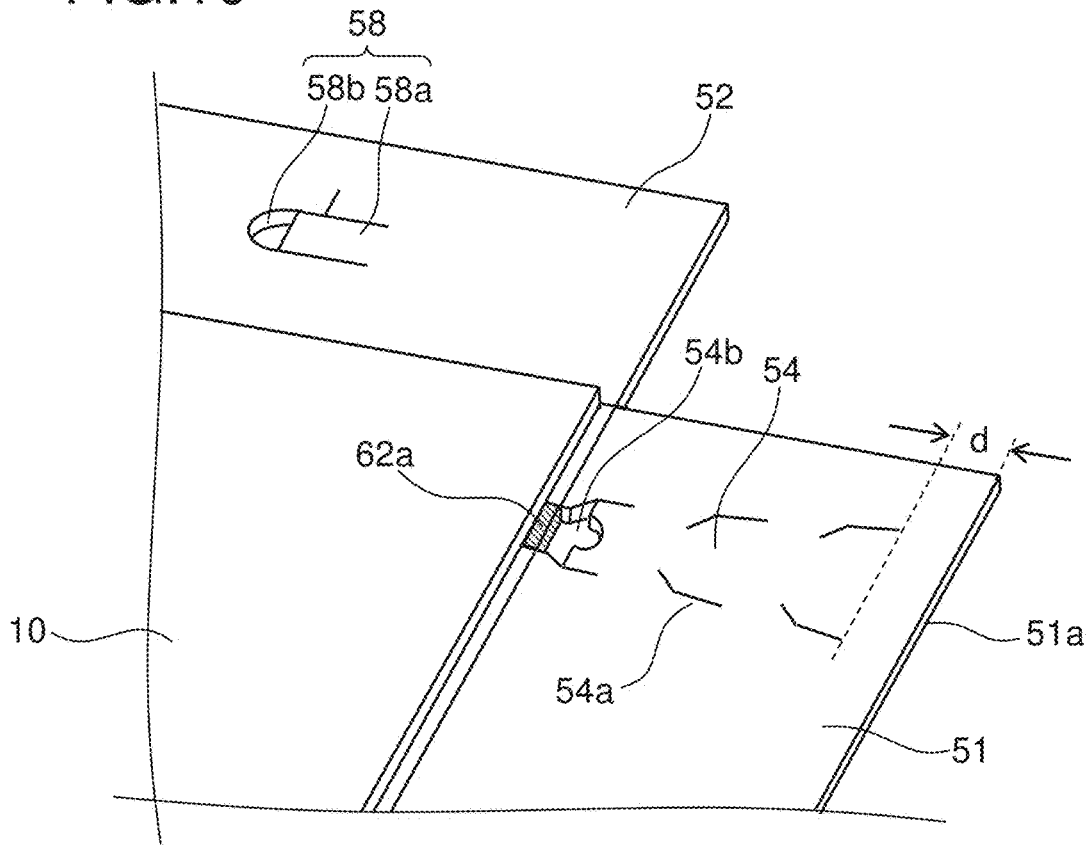
FIG. 10 is an enlarged perspective view of and around a second zipper portion of the tray-equipped pallet according to the second embodiment.

FIG. 8 is a perspective view of a tray-equipped pallet 2 according to a second embodiment of the present disclosure. FIG. 9 is a perspective view showing a state where support plates 10 have been removed from the tray-equipped pallet 2 according to the second embodiment. FIG. 10 is an enlarged perspective view of and around a second zipper portion 54 (in a broken line circle S in FIG. 8) of the tray-equipped pallet 2 according to the second embodiment. In this embodiment, two second breaking lines 54*a* defining the second zipper portion 54 are formed not to extend to a distal end 51*a* of each of first flaps 51. To be more specific, as shown in FIG. 10, a prescribed spacing d is provided between the two second breaking lines 54*a* defining the second zipper portion 54 and the distal end 51*a* of each of the first flaps 51.

Furthermore, the second zipper portion 54 includes a first finger hooking portion 54*b* formed between itself and a connection portion 62*a*. The first finger hooking portion 54*b* is an opening formed in the first flaps 51. An opening edge of the first finger hooking portion 54*b* near the second zipper portion 54 has a circular arc shape for case in hooking a finger thereon.

Furthermore, each of second flaps 52 includes a second finger hooking portion 58 formed at each of positions thereon close to the first flaps 51 (both longitudinal ends thereof). The second finger hooking portion 58 is composed of a cut piece 58*a* to be raised and a finger insertion hole 58*b*. An end of the cut piece 58*a* near a neighboring one of the first flaps 51 is connected to the each of the second flaps 52. The finger insertion hole 58*b* is formed to adjoin a distal end of the cut piece 58*a* (an end thereof distant from the neighboring one of the first flaps 51).

Figure 11:
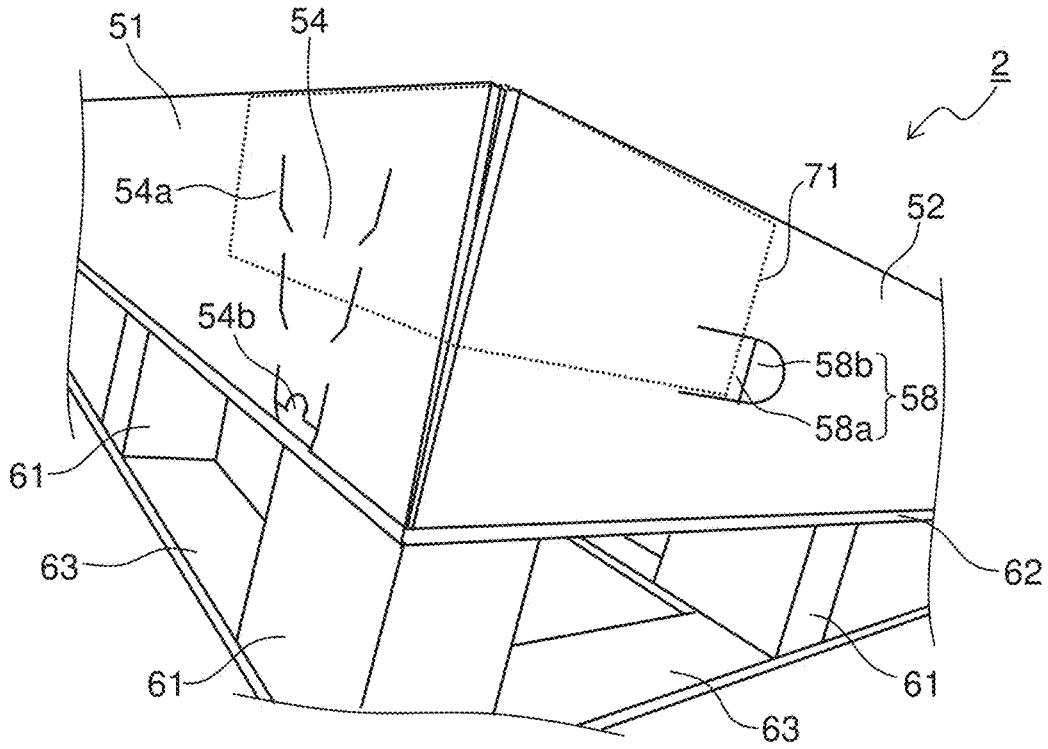
FIG. 11 is a partial perspective view showing a state where first and second flaps of the tray-equipped pallet according to the second embodiment are retained in an upright state by use of a pressure-sensitive adhesive tape.

FIG. 11 is a partial perspective view showing a state where the first and second flaps 51 and 52 of the tray-equipped pallet 2 according to the second embodiment are retained in an upright state by use of a pressure-sensitive adhesive tape 71. While FIG. 11 only shows one of corners of the tray-equipped pallet 2, the other three corners also have a similar configuration.

When the packaging member 1 including the tray-equipped pallet 2 is used to pack the product P, as shown in FIG. 1, it is required that the first and second flaps 51 and 52 be brought to an upright posture beforehand so that the tray-equipped pallet 2 and the upper case 3 can be connected together.

To this end, as shown in FIG. 11, the pressure-sensitive adhesive tape 71 is affixed to extend from the first flaps 51 over to the second flaps 52. Thus, the first and second flaps 51 and 52 are retained in an upright state. The pressure-sensitive adhesive tape 71 is made of resin (for example, polypropylene) and has one side with a pressure-sensitive adhesive applied thereto. The pressure-sensitive adhesive tape 71 is affixed to extend from a position overlapping the second breaking lines 54*a* of the second zipper portion 54 to a position overlapping the cut piece 58*a* of the second finger hooking portion 58 across each boundary between the first and second flaps 51 and 52.

Next, a description is given of a procedure for separating, from each other, a tray 5 and a pallet 6 of the tray-equipped pallet 2 according to this embodiment. First, from the state shown in FIG. 11, a finger is inserted into the finger insertion hole 58*b* of the second finger hooking portion 58, and the cut piece 58*a* is raised outward with the finger. This causes, together with the cut piece 58*a*, an end edge of the pressure-sensitive adhesive tape 71 to be lifted, which is then grasped, and the pressure-sensitive adhesive tape 71 is peeled off from the first and second flaps 51 and 52.

Next, similarly to the first embodiment, two first zipper portions 53 are torn off along first breaking lines 53*a*. Thus, the tray 5 is severed at a middle of each of the second flaps 52 so as to be divided into an area including a first bottom surface portion 50*a* and an area including a second bottom surface portion 50*b*.

Next, a finger is inserted into the first finger hooking portion 54*b* of the second zipper portion 54, and an end edge of the second zipper portion 54 near the connection portion 62*a* is grasped and pulled toward the distal end 51*a* of a corresponding one of the first flaps 51. In this way, the second zipper portion 54 is torn off along the second breaking lines 54*a*. In a similar manner, four second zipper portions 54 in the first flaps 51 are torn off along the second breaking lines 54*a*.

Thus, similarly to the first embodiment, the areas of the tray 5 including the first and second bottom surface portions 50*a* and 50*b*, respectively, become movable to opposite sides to the first flaps 51 (to an inner side of the pallet 6). Accordingly, it is possible, by grasping a grasping portion 55 in each of the areas including the first and second bottom surface portions 50*a* and 50*b*, respectively, to pull out these areas in opposite directions to the first flaps 51 (in the directions of hatched arrows in FIG. 6).

In the tray-equipped pallet 2 according to the first embodiment, the two second breaking lines 54*a* defining the second zipper portion 54 are formed to extend to a distal end 51*a* of each of the first traps 51. This has led to a possibility that, when the packaging member 1 including the tray-equipped pallet 2 is used to pack the product P, upon the packaging member 1 being subjected to an impact, such as when it is dropped, breakage of any of the first flaps 51 might occur from the distal end 51*a* thereof along the second breaking lines 54*a*.

In this embodiment, the prescribed spacing d is provided between the second breaking lines 54*a* and the distal end 51*a* of each of the first flaps 51. With this configuration, it is possible to effectively suppress a phenomenon in which, upon the packaging member 1 being subjected to an impact, breakage of any of the first flaps 51 might occur along the second breaking lines 54*a*.

Furthermore, the second zipper portion 54 includes the first finger hooking portion 54*b* formed between itself and the connection portion 62*a*. With this configuration, a finger is inserted into the first finger hooking portion 54*b*, and the end edge of the second zipper portion 54 near the connection portion 62*a* is grasped and pulled toward the distal end 51*a* of a corresponding one of the first flaps 51, and thus the second zipper portion 54 can be easily torn off along the second breaking lines 54*a*.

Moreover, the first and second flaps 51 and 52 are retained in an upright state by use of the pressure-sensitive adhesive tape 71, and thus after the product P has been placed on the tray-equipped pallet 2, the tray-equipped pallet 2 and the upper case 3 can be easily connected together. Further, each of the second flaps 52 includes the second finger hooking portion 58 formed at a position thereon overlapping an end edge of the pressure-sensitive adhesive tape 71, and thus in separating, from each other, the tray 5 and the pallet 6 of the tray-equipped pallet 2, it is possible, by hooking a finger on the second finger hooking portion 58, to easily peel off the pressure-sensitive adhesive tape 71.

In addition, the present disclosure is not limited to the foregoing embodiments and can be variously modified without departing from the spirit of the present disclosure. For example, while in the foregoing embodiments, the first zipper portion 53 is provided with respect to each of the pair of second flaps 52, and a gap is formed between the first zipper portions 53, a configuration may also be adopted in which a single first zipper portion 53 is provided to extend continuously between the pair of second flaps 52.

Furthermore, while in the foregoing embodiments, the connection portion 62*a* is provided at each of four locations on the top plate 62 of the pallet 6, the engagement hole 57 with which the connection portion 62*a* engages is formed at each of four locations on the bottom surface 50 of the tray 5, and the second zipper portion 54 is formed to adjoin the engagement hole 57, the numbers and arrangements of the connection portions 62*a*, the engagement holes 57, and the second zipper portions 54 can be freely set. Furthermore, while the forgoing embodiments use the nail 70 to secure each of the support plates 10 to the connection portion 62*a* of the tray 6, for example, an adhesive may also be used for this purpose.

Furthermore, while the foregoing embodiments have described the tray-equipped pallet 2 including the tray 5 made of a corrugated cardboard sheet and other wooden parts that are the pallet 6 and the support plates 10, the present disclosure is not limited thereto. For example, the present disclosure is applicable also to a tray-equipped pallet 2 including a tray 5 made of a resinous sheet and/or a pallet 6 and support plates 10 that are made of metal.

The present disclosure is usable in a tray-equipped pallet including a pallet and a tray that are made of different materials and are secured together. Through the use of the present disclosure, it is possible to provide a tray-equipped pallet that is easily separable into a pallet and a tray and a packaging member including the same.

What is claimed is:

1. A tray-equipped pallet, comprising:

a pallet that includes a plurality of columns, a top plate secured to upper surfaces of the plurality of columns, and a bottom plate secured to lower surfaces of the plurality of columns;

a tray that is made of a sheet and includes a rectangular bottom surface secured to the top plate of the pallet; and a pair of support plates that is secured to overlie the bottom surface of the tray, wherein the pallet includes a connection portion that protrudes from an upper surface of the top plate and to which each of the pair of support plates is secured, the tray includes:

an engagement hole that is formed in the bottom surface and with which the connection portion engages;

a first zipper portion that enables, when torn off, separation of the bottom surface into a first bottom surface portion on one side and a second bottom surface portion on another side; and a second zipper portion that is formed to adjoin the engagement hole and enables, when torn off, breakage of a part of the engagement hole on an opposite side to the first zipper portion, and after the first and second zipper portions have been torn off, each of the first and second bottom surface portions is pulled out in an opposite direction to the broken part of the engagement hole, and thus separation of the tray from the pallet and the pair of support plates is enabled.

2. The tray-equipped pallet according to claim 1, wherein the tray includes:

a pair of first flaps connected to opposed two sides of the bottom surface via a crease line; and a pair of second flaps connected, via a crease line, to two other sides of the bottom surface to which the pair of first flaps is not connected, the first zipper portion is a region interposed between two first breaking lines extending from each of the pair of second flaps to the bottom surface across the crease line, the second zipper portion is a region enclosed with two second breaking lines extending from a distal end of each of the pair of first flaps toward the crease line, on the bottom surface, the engagement hole is formed at a location adjoining the second zipper portion via the crease line, the pair of support plates is arranged along two respective sides of the first and second bottom surface portions adjoining the first flaps, and after the first and second zipper portions have been torn off, the first and second bottom surface portions are pulled out in opposite directions to the first flaps, and thus separation of the tray from the pallet and the pair of support plates is enabled.

3. The tray-equipped pallet according to claim 2, wherein the second breaking lines are formed at a prescribed spacing from the distal end of each of the first flaps.

4. The tray-equipped pallet according to claim 3, wherein the second zipper portion includes a first finger hooking portion formed between the second zipper portion and the connection portion.

5. The tray-equipped pallet according to claim 3, wherein the first and second flaps are retained in an upright state by use of a pressure-sensitive adhesive tape, and the pressure-sensitive adhesive tape is affixed to extend from the second zipper portion to a neighboring one of the second flaps across a corresponding one of boundaries between the first and second flaps.

6. The tray-equipped pallet according to claim 5, wherein each of the second flaps includes a second finger hooking portion formed at a position thereon overlapping an end edge of the pressure-sensitive adhesive tape.

7. The tray-equipped pallet according to claim 6, wherein the second finger hooking portion includes:

a cut piece to be raised having an end near a neighboring one of the first flaps, which is connected to a corresponding one of the second flaps; and a finger insertion hole formed to adjoin a distal end of the cut piece.

8. The tray-equipped pallet according to claim 1, wherein a grasping portion is formed at substantially a middle of each of respective sides of the first and second bottom surface portions opposed to each other via the first zipper portion.

9. The tray-equipped pallet according to claim 1, wherein the pallet and the pair of support plates are made of wood, and the tray is made of a corrugated cardboard sheet.

10. A packaging member, comprising:

the tray-equipped pallet according to claim 1;

an upper case having a cylindrical shape with an open bottom surface, thus covering side and upper surfaces of an article to be packed, which is placed on the tray-equipped pallet; and a buffer member that is placed between the article to be packed and the upper case.

* * * * *